US009115544B2

(12) United States Patent
Harms et al.

(10) Patent No.: US 9,115,544 B2
(45) Date of Patent: Aug. 25, 2015

(54) MODULAR DOWNHOLE TOOLS AND METHODS

(75) Inventors: Kent David Harms, Richmond, TX (US); Jeremy Murphy, Sugar Land, TX (US); Julian J. Pop, Houston, TX (US); Steven Villareal, Houston, TX (US); Albert Hoefel, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 437 days.

(21) Appl. No.: 13/305,369

(22) Filed: Nov. 28, 2011

(65) Prior Publication Data

US 2013/0133882 A1 May 30, 2013

(51) Int. Cl.

| | |
|---|---|
| ***E21B 17/00*** | (2006.01) |
| ***E21B 49/10*** | (2006.01) |
| ***H01R 13/00*** | (2006.01) |
| *H01R 13/64* | (2006.01) |

(52) U.S. Cl.

CPC ..... *E21B 17/003* (2013.01); *E21B 49/10* (2013.01); *H01R 13/005* (2013.01); *H01R 13/64* (2013.01); *Y10T 29/49117* (2015.01)

(58) Field of Classification Search

CPC ... E21B 17/028; E21B 17/023; E21B 17/003; E21B 47/01

USPC ..... 175/40, 320; 166/250.1, 65.1

See application file for complete search history.

(56) References Cited

U.S. PATENT DOCUMENTS

| | | | | |
|---|---|---|---|---|
| 6,688,396 | B2 | 2/2004 | Floerke et al. | |
| 6,837,314 | B2 | 1/2005 | Krueger et al. | |
| 6,880,647 | B2 * | 4/2005 | Villareal | 175/40 |
| 6,986,282 | B2 | 1/2006 | Ciglenec et al. | |
| 7,114,562 | B2 | 10/2006 | Fisseler et al. | |
| 7,543,659 | B2 * | 6/2009 | Partouche et al. | 175/320 |
| 7,600,420 | B2 | 10/2009 | Meek | |
| 2006/0283606 | A1 * | 12/2006 | Partouche et al. | 166/380 |
| 2008/0245570 | A1 * | 10/2008 | Partouche | 175/48 |
| 2009/0025926 | A1 | 1/2009 | Briquet et al. | |
| 2009/0166085 | A1 | 7/2009 | Ciglenec et al. | |
| 2009/0195250 | A1 | 8/2009 | Welshans et al. | |
| 2009/0229817 | A1 * | 9/2009 | Partouche | 166/242.6 |
| 2010/0170678 | A1 * | 7/2010 | Marlow et al. | 166/360 |
| 2010/0257926 | A1 | 10/2010 | Yamate et al. | |
| 2011/0127085 | A1 | 6/2011 | Partouche | |

FOREIGN PATENT DOCUMENTS

WO WO 2009042494 A2 * 4/2009 ..... E21B 17/02

OTHER PUBLICATIONS

International Search Report & Written Opinion issued in PCT/US2012/066701 on Feb. 28, 2013; 12 pages.

* cited by examiner

*Primary Examiner* — Brad Harcourt
*Assistant Examiner* — Steven MacDonald
(74) *Attorney, Agent, or Firm* — Cathy Hewitt; Kenneth L. Kincaid

(57) ABSTRACT

An apparatus includes a downhole tool for conveyance in a wellbore extending into a subterranean formation. The downhole tool includes a modular cartridge assembly that includes a chassis assembly within a housing and that includes a flow line and an electrical pathway. The modular cartridge assembly includes a first connector at a first end and a second connector at a second end. The first connector and the second connector are in fluid communication with the flow line and are further in electrical communication with the electrical pathway.

28 Claims, 12 Drawing Sheets

MODULAR DOWNHOLE TOOLS AND METHODS

BACKGROUND OF THE DISCLOSURE

Wellbores (also known as boreholes) are drilled to penetrate subterranean formations for hydrocarbon prospecting and production. During drilling operations, evaluations may be performed of the subterranean formation for various purposes, such as to locate hydrocarbon-producing formations and manage the production of hydrocarbons from these formations. To conduct formation evaluations, the drill string may include one or more drilling tools that test and/or sample the surrounding formation, or the drill string may be removed from the wellbore, and a wireline tool may be deployed into the wellbore to test and/or sample the formation.

These drilling tools and wireline tools, as well as other wellbore tools conveyed on coiled tubing, drill pipe, casing or other conveyers, are also referred to herein as "downhole tools." Such downhole tools may include a plurality of integrated collar assemblies, each for performing a separate function, and a downhole tool may be employed alone or in combination with other downhole tools in a downhole tool string.

Formation evaluation may involve drawing fluid from the formation into a downhole tool (or collar assembly thereof) for testing in situ and/or sampling. Various devices, such as probes and/or packers, may be extended from the downhole tool to isolate a region of the wellbore wall, and thereby establish fluid communication with the subterranean formation surrounding the wellbore. Fluid may then be drawn into the downhole tool using the probe and/or packer.

The collection of such formation fluid samples while drilling may be performed with an integrated sampling/pressure tool that contains several collar assemblies, each for performing various functions, such as electrical power supply, hydraulic power supply, fluid sampling (e.g., probe or dual packer), fluid analysis, and sample collection (e.g., tanks).

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
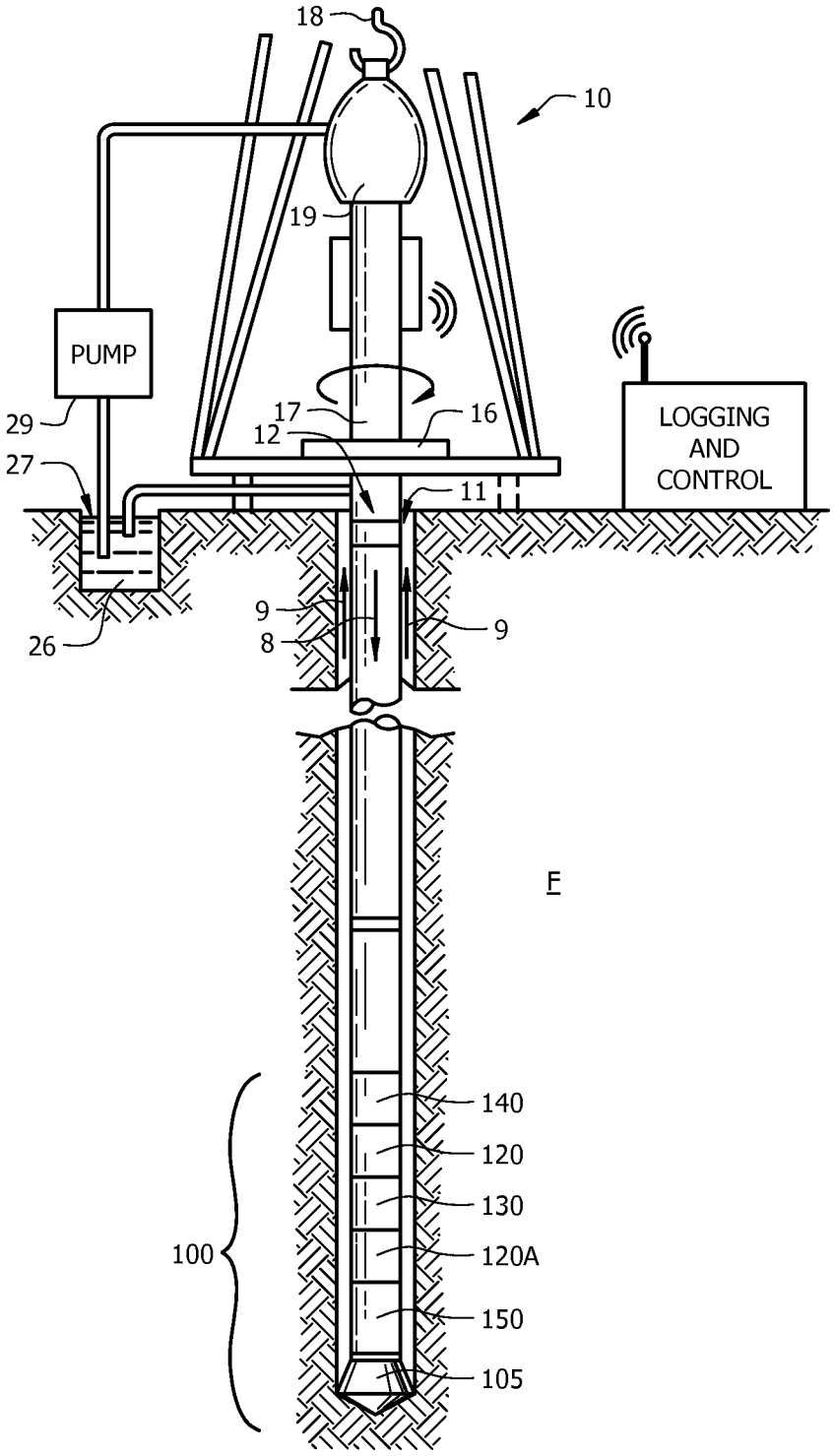
FIG. 1 is a schematic view, partially in cross-section, of a well site system including a drill string extending from a rig into a wellbore penetrating a subterranean formation, the drill string including a logging while drilling downhole tool.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

FIG. 1 illustrates a well site system in which aspects of the present disclosure may be implemented. The well site can be onshore or offshore. A platform and derrick assembly 10 are positioned over a wellbore 11 penetrating a subterranean formation F. The wellbore 11 is formed by rotary drilling in a manner than is well known. However, embodiments of the present disclosure can also be employed in directional drilling applications.

A drill string 12 is suspended within the wellbore 11 and has a bottom hole assembly 100 including a drill bit 105 at its lower end. The platform and derrick assembly 10 includes a rotary table 16, a kelly 17, a hook 18 and a rotary swivel 19.

The drill string 12 is rotated by the rotary table 16, energized by means not shown, which engages the kelly 17 at the upper end of the drill string 12. The drill string 12 is suspended from the hook 18, attached to a traveling block (also not shown), through the kelly 17 and the rotary swivel 19, which permits rotation of the drill string 12 relative to the hook 18. A top drive system could alternatively be used.

A drilling fluid 26 is stored in a pit 27 formed at the well site. A pump 29 delivers the drilling fluid 26 to the interior of the drill string 12 via a port in the swivel 19, inducing the drilling fluid 26 to flow downwardly through the interior of the drill string 12 as indicated by the directional arrow 8. The drilling fluid 26 exits the drill string 12 via ports in the drill bit 105, and then circulates upwardly through the annulus region between the outside of the drill string 12 and the wall of the wellbore 11, as indicated by the directional arrows 9. The drilling fluid 26 is referred to as drilling mud when it enters and flows through the annulus region. The drilling fluid 26 lubricates the drill bit 105, and the drilling mud carries formation cuttings up to the surface as it is returned through the annulus region to the pit 27 for recirculation.

The bottom hole assembly 100 of the illustrated embodiment comprises a logging-while-drilling (LWD) collar module 120, a measuring-while-drilling (MWD) module 130, a roto-steerable system and motor 150, and the drill bit 105. Additional components (e.g., 140) may also be included in the bottom hole assembly 100.

The LWD module 120 is housed in a special type of drill collar assembly, as is known in the art, and can contain one or a plurality of different downhole tools comprising logging tools. It will also be understood that more than one LWD and/or MWD module can be employed, e.g. as represented by 120A. (References, throughout, to a module at the position of 120 can alternatively mean a module at the position of 120A as well.) The LWD module 120 includes capabilities for measuring, processing, and storing information, as well as for communicating with the surface equipment.

The MWD module 130 is also housed in a special type of drill collar, as is known in the art, and can contain one or more devices for measuring characteristics of the drill string and drill bit. The MWD tool further includes an apparatus (not shown) for generating electrical power to the drill string 12. This may typically include a mud turbine generator powered by the flow of the drilling fluid 26, it being understood that other power and/or battery systems may be employed. In the present embodiment, the MWD module 130 may include one or more of the following types of measuring devices: a weight-on-bit measuring device, a torque measuring device, a vibration measuring device, a shock measuring device, a stick slip measuring device, a direction measuring device, and an inclination measuring device.

Figure 2:
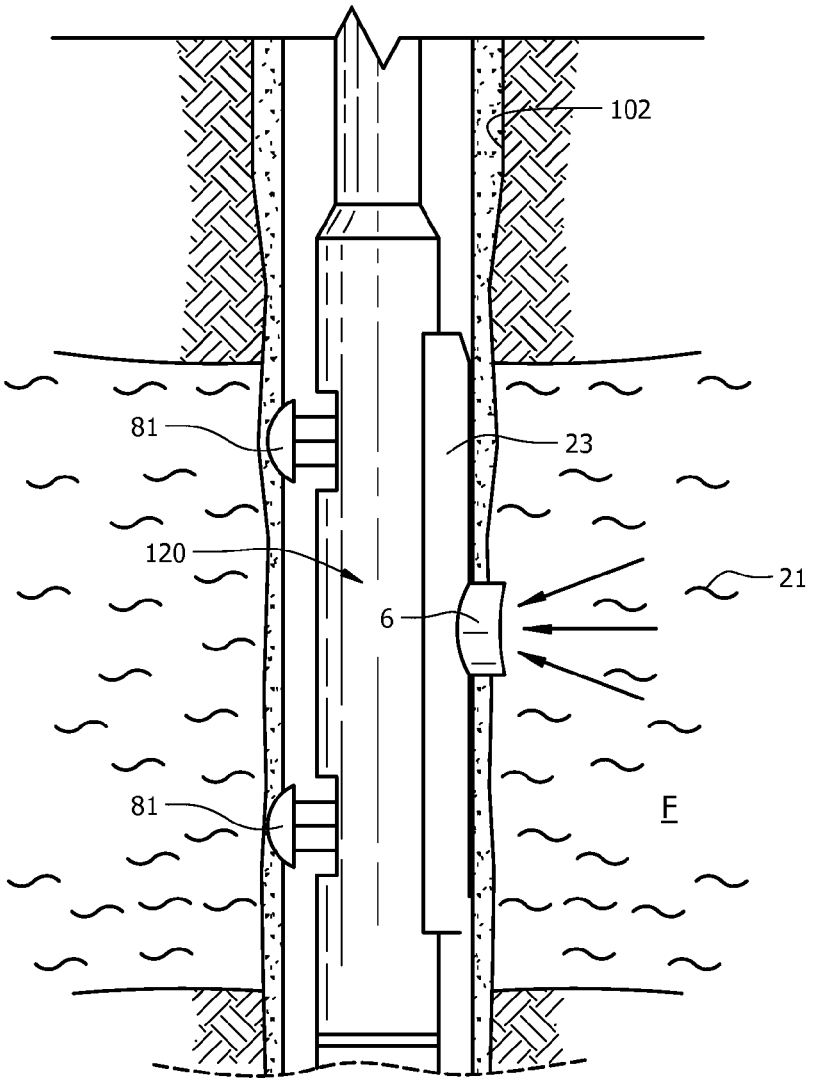
FIG. 2 is a schematic view, partially in cross-section, of a sampling while drilling logging device.

In an embodiment, the LWD module 120 may include a sampling-while-drilling logging device. FIG. 2 is a simplified diagram of a sampling-while-drilling logging device of a type described in U.S. Pat. No. 7,114,562, incorporated herein by reference, utilized as the LWD tool 120 or part of an LWD tool suite 120A. The LWD tool 120 is provided with a probe 6 for establishing fluid communication with the formation F and drawing the fluid 21 into the LWD tool 120, as indicated by the arrows. The probe may be positioned in a stabilizer blade 23 of the LWD tool 120 and extended therefrom to engage the wellbore wall 102. The stabilizer blade 23 may comprise one or more blades that are in contact with the wellbore wall 102. Fluid drawn into the LWD tool 120 using the probe 6 may be measured to determine, for example, pretest and/or pressure parameters. Additionally, the LWD tool 120 may be provided with devices, such as sample chambers, for collecting fluid samples for retrieval at the surface. Backup pistons 81 may also be provided to assist in applying force to push the LWD tool 120 and/or probe 6 against the wellbore wall 102.

Figure 3:
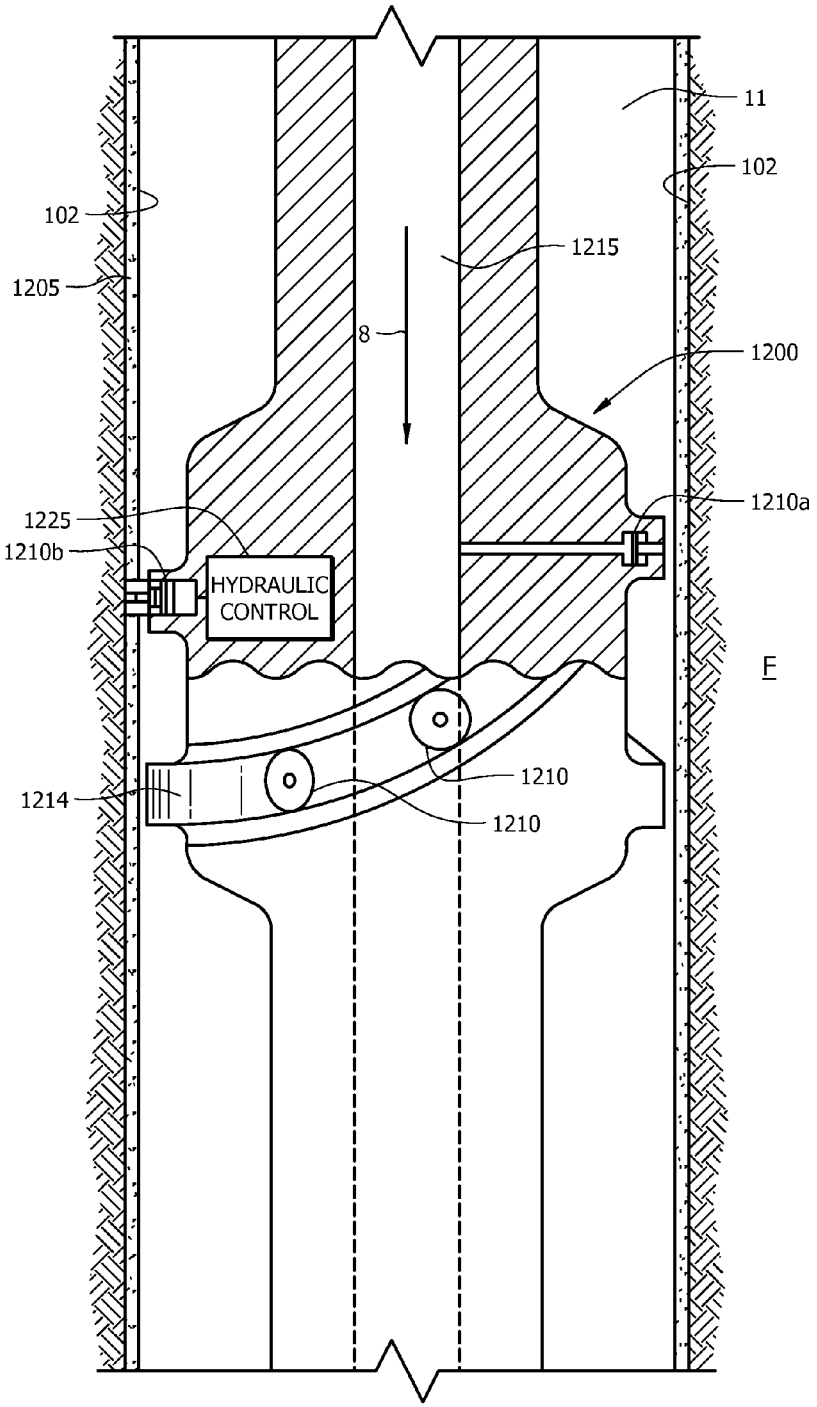
FIG. 3 is a schematic view, partially in cross-section, of a pressure measuring logging device.

In an embodiment, the LWD module 120 may include a pressure measuring logging device. FIG. 3 is a simplified diagram of a pressure measuring logging device, of a type disclosed in U.S. Pat. No. 6,986,282, incorporated herein by reference, for determining downhole pressures including annular pressure, formation pressure, and pore pressure, during a drilling operation, it being understood that other types of pressure measuring LWD tools can also be utilized as the LWD tool 120 or part of a LWD tool suite 120A. The pressure-measuring device is formed in a modified stabilizer collar 1200 with a passage 1215 extending therethrough for drilling fluid 26. The flow of drilling fluid 26 through the tool, as indicated by flow arrow 8 creates an internal pressure PI. The exterior of the modified stabilizer collar 1200 is exposed to the annular pressure PA of the surrounding wellbore 11. The differential pressure $\delta P$ between the internal pressure PI and the annular pressure PA is used to activate the pressure assemblies 1210. Two representative pressure-measuring assemblies are shown at 1210*a* and 1210*b*, respectively mounted on stabilizer blades. Pressure assembly 1210*a* is used to monitor annular pressure in the wellbore 11 and/or pressures of the surrounding formation F when positioned in engagement with the wellbore wall 102. In FIG. 3, pressure assembly 1210*a* is depicted in non-engagement with the wellbore wall 102 and, therefore, may measure annular pressure in the wellbore 11, if desired. When moved into engagement with the wellbore wall 102, the pressure assembly 1210*a* may be used to measure pore pressure of the surrounding formation F. As also depicted in FIG. 3, pressure assembly 1210*b* may be extendable from the stabilizer blade 1214, using hydraulic control 1225, for sealing engagement with a mudcake 1205 and/or the wall 102 of the wellbore 11 for taking measurements of the surrounding formation F. The above referenced U.S. Pat. No. 6,986,282 can be referred to for further details. Circuitry (not shown in this view) couples pressure-representative signals to a processor/controller, an output of which is coupleable to telemetry circuitry.

Figure 4:
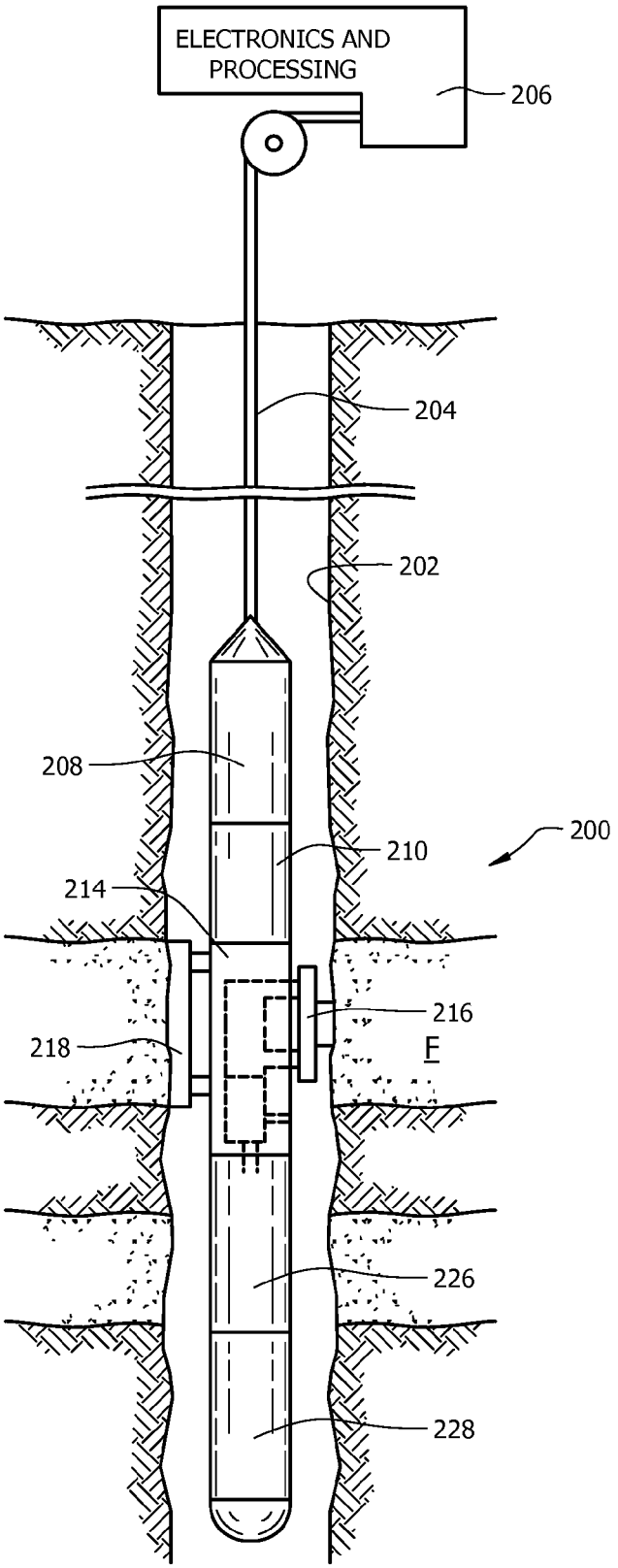
FIG. 4 is a schematic view, partially in cross-section, of a wireline tool suspended from a cable into a wellbore penetrating a subterranean formation, the wireline tool including a formation tester.

FIG. 4 depicts a wireline tool 200 that may be another environment in which aspects of the present disclosure may be implemented. The wireline tool 200 is suspended in a wellbore 202 from the lower end of a multiconductor cable 204 that is spooled on a winch (not shown) at the Earth's surface. At the surface, the cable 204 is communicatively coupled to an electronics and processing system 206. The wireline tool 200 includes an elongated body 208 that includes a formation tester 214 having a selectively extendable probe assembly 216 and a selectively extendable tool anchoring member 218 that may be arranged on opposite sides of the elongated body 908. Additional components (e.g., 210) may also be included in the tool 900.

One or more aspects of the probe assembly 216 may be substantially similar to those described above in reference to the embodiment shown in FIG. 2. For example, the extendable probe assembly 216 is configured to selectively seal off or isolate selected portions of the wall of the wellbore 202 to fluidly couple to the adjacent formation F and/or to draw fluid samples from the formation F. The formation fluid may be expelled through a port (not shown) or it may be sent to one or more fluid collecting chambers 226 and 228. In the illustrated example, the electronics and processing system 206 and/or a downhole control system are configured to control the extendable probe assembly 216 and/or the drawing of a fluid sample from the formation F.

Figure 5:
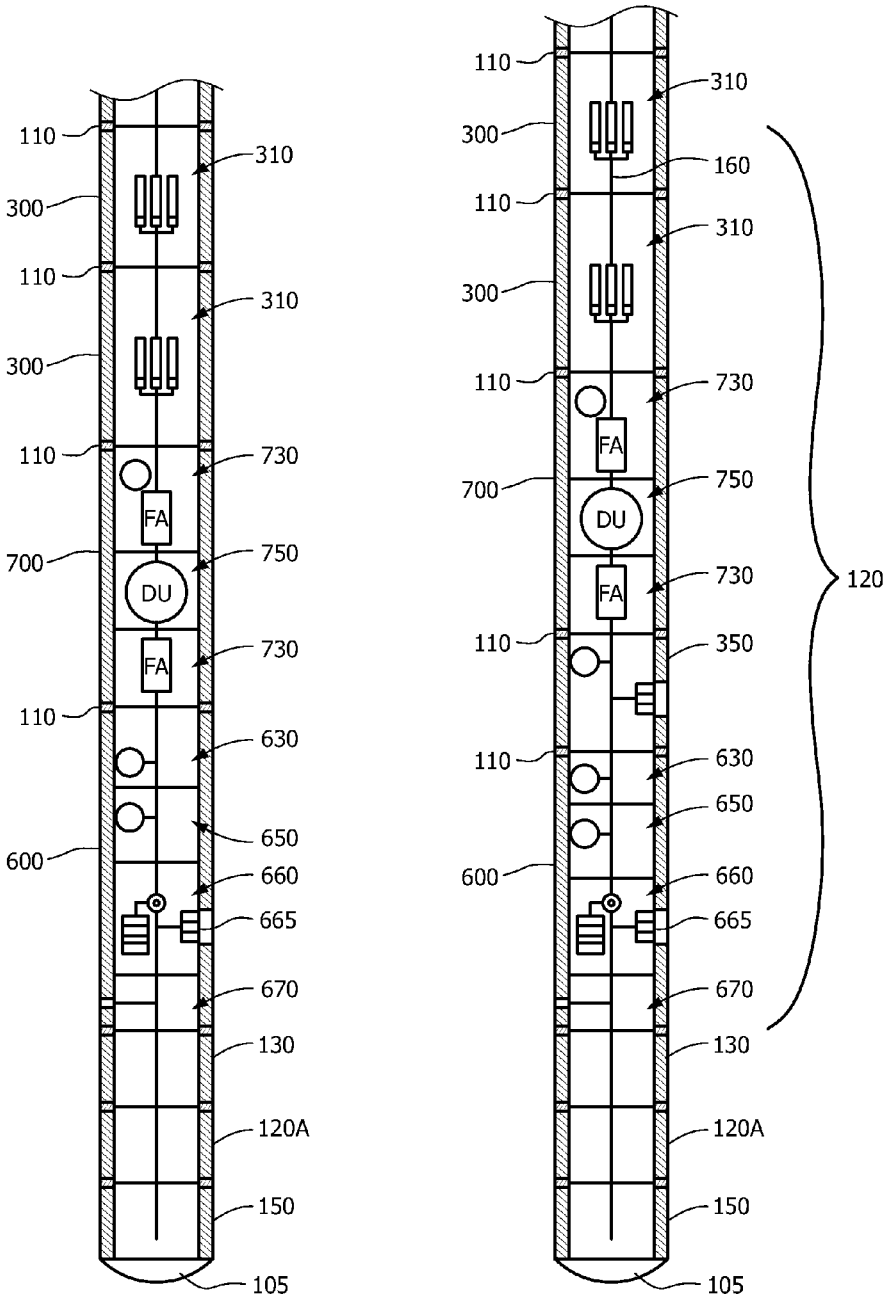
FIG. 5 is schematic views of a portion of the bottom hole assembly of FIG. 1, the schematic views depicting two embodiments of a sampling while drilling downhole tool and several of the associated collar assemblies in more detail according to one or more aspects of the present disclosure.

FIG. 5 schematically illustrates two embodiments of a sampling while drilling downhole tool 120 of the bottom hole assembly of FIG. 1. Both embodiments of the downhole tool 120 comprise a string of collar assemblies coupled together in series via module connectors 110. The module connectors 110 are employed for conducting sampling fluid between adjacent collar assemblies and for conducting electrical signals through an electrical line 160 that runs through the collar assemblies for communicating power and/or data between the various collar assemblies. The module connectors 110 may also connect hydraulic lines that run through the collar assemblies.

The embodiment of the downhole tool 120 shown on the left side of FIG. 5 comprises two sample carrier collar assemblies 300, a fluid pumping collar assembly 700, and a probe collar assembly 600 coupled together in series mechanically, fluidly and electrically by module connectors 110 on each end of the various collar assemblies 300, 600, 700. The module connectors 110 may comprise standard features to permit coupling of the collar assemblies in any order for configuring and reconfiguring the downhole tool 120 at the well site. For example, the embodiment of the downhole tool 120 on the right side of FIG. 5 comprises the same collar assemblies 300, 600, 700 as the embodiment on the left side of FIG. 5, but the right side embodiment also includes a sample probe collar assembly 350 coupled between the fluid pumping collar assembly 700 and the probe collar assembly 600. Any number of different configurations of collar assemblies is possible, including additional collar assemblies, such as a memory sub, a measurement sub, and a fluid routing sub, for example.

As described in more detail herein, one or more of the collar assemblies 300, 600, 700 may include one or more subs and a collar that houses at least one modular cartridge assembly according to aspects of the present disclosure. For example, the sample carrier collar assembly 300 may house a sample bottle cartridge assembly 310 therein. The probe collar assembly 600 may house a fluid analyzer cartridge assembly 630, a hydraulic cartridge assembly 650, a pretest cartridge assembly 660 with an extendable probe 665, and a fluid routing/equalization cartridge assembly 670 therein. The fluid pumping collar assembly 700 may house a fluid displacement cartridge assembly 750 and at least one fluid analyzer cartridge assembly 730 therein. Any one or more of such cartridge assemblies 310, 630, 650, 660, 670, 730, 750 may be a modular cartridge assembly according to aspects of the present disclosure.

Such modular cartridge assemblies may facilitate more flexibility and customization of the downhole tool 120 beyond any modularity and configurability provided at the collar assembly level. As described in further detail herein, these modular cartridge assemblies may comprise modular end connectors with standard features that permit coupling of the cartridge assemblies in any order for configuring and reconfiguring a collar assembly of a downhole tool 120 as desired. Configuring and reconfiguring a collar assembly may include coupling specific modular cartridge assemblies in a desired order for a given project or to meet customer requirements, for example. Reconfiguring a collar assembly may include removing a modular cartridge assembly to perform calibration, to shorten the downhole tool 120, and to prevent failure of the cartridge assembly in a harsh drilling environment, for example. Each modular cartridge assembly can be separately manufactured, tested/calibrated, and/or replaced. Collar assemblies may further be upgraded as new technologies are incorporated into modular cartridge assemblies.

Figure 6:
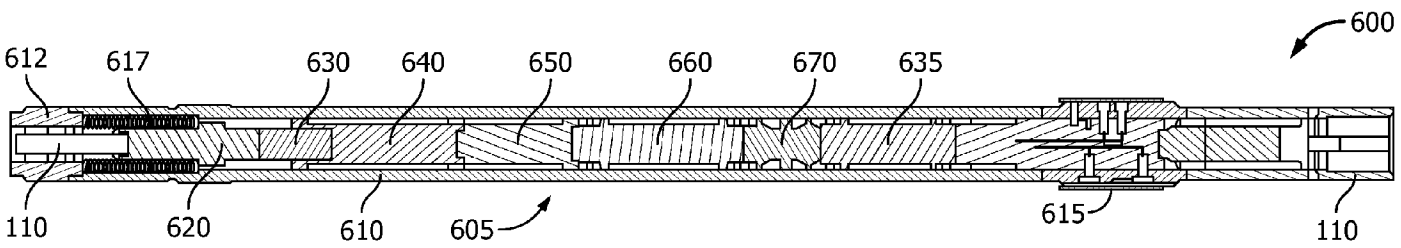
FIG. 6 is a more detailed schematic view of the probe collar assembly of the downhole tool of FIG. 5, the probe collar assembly including a plurality of modular cartridge assemblies coupled in series according to one or more aspects of the present disclosure.

FIG. 6 shows the probe collar assembly 600 of FIG. 5 in greater detail. The probe collar assembly 600 comprises a plurality of cartridge assemblies coupled together in series and disposed within a collar 605 that comprises a tubular portion 610, a machined portion 615 and module connectors 110 at each end thereof. A spring pack 617 may be compressed between the plurality of cartridge assemblies and a jam sub 612 coupled to the collar 605 to flexibly retain the plurality of cartridge assemblies within the collar 605.

The cartridge assemblies of the probe collar assembly 600 comprise a power source 620, such as a battery, coupled to a first fluid analyzer 630 that may include sensor devices, such as micro fluidics sensors. The first fluid analyzer 630 in turn is coupled to an electronics cartridge assembly 640 that may allow relatively autonomous operation of the probe collar assembly 600 via a processor board, a controller board and/or a memory board. The electronics cartridge assembly in turn is coupled to a hydraulic cartridge assembly 650 that may comprise a pump to energize hydraulic fluid. The hydraulic cartridge assembly 650 in turn is coupled to a pretest cartridge assembly 660 that may comprise a drawdown piston 665 controlled by a motor and a roller screw, for example. The pretest cartridge assembly 660 in turn is coupled to a fluid routing/equalization cartridge assembly 670 that may comprise one or more valves, for example. The fluid routing/equalization cartridge assembly 670 in turn is coupled to a second fluid analyzer cartridge assembly 635 that may comprise pressure gauges, for example. The electronics cartridge assembly 640 is communicably coupled to the electric line 160 for communicating data and/or power therebetween. In addition, the electronics cartridge assembly 640 may be communicably coupled to one or more of the sensors disposed in and around the probe collar assembly 600, such as the sensors (e.g. optical sensors, pressure gauges, micro fluidic sensors) within the fluid analyzer cartridge assemblies 630, 635, for example. Any one or more of the cartridge assemblies 620, 630, 640, 650, 660 and 670 may be a modular cartridge assembly according to aspects of the present disclosure as described in more detail herein. In an embodiment, all of the cartridge assemblies of the probe collar assembly 600 may be modular cartridge assemblies.

Figure 7:
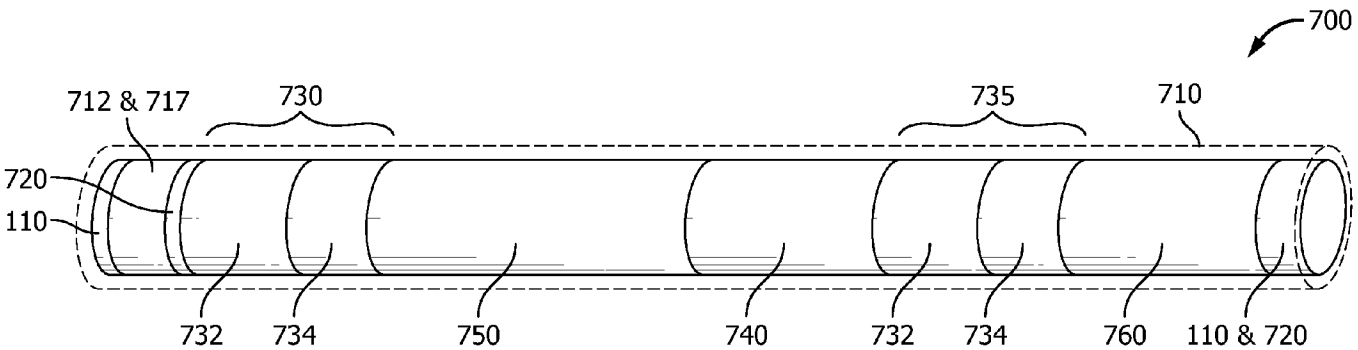
FIG. 7 is a more detailed schematic view of the fluid pumping collar assembly of the downhole tool of FIG. 5, the fluid pumping collar assembly including a plurality of modular cartridge assemblies coupled in series according to one or more aspects of the present disclosure.

FIG. 7 shows the fluid pumping collar assembly (pump out module) 700 of FIG. 5 in greater detail. The fluid pumping collar assembly 700 comprises a plurality of cartridge assemblies coupled together in series and disposed within a tubular collar 710 with module connectors 110 at each end thereof. A spring pack 717 may be compressed between the plurality of cartridge assemblies and a jam sub 712 coupled to the collar 710 to flexibly retain the plurality of cartridge assemblies within the collar 710.

The cartridge assemblies of the fluid pumping collar assembly 700 comprise a flow diverter 720 coupled to a first fluid analyzer 730 that comprises a plurality of sensor cartridge assemblies 732, 734, such as an optical cartridge assembly, a pressure gauge cartridge assembly and/or a micro fluidic sensor cartridge assembly, for example. The first fluid analyzer 730 in turn is coupled to a fluid displacement cartridge assembly 750 that may comprise a pump to flow fluid (e.g. formation fluid, wellbore fluid, drilling fluid) through a flow line. The fluid displacement cartridge assembly 750 in turn is coupled to an electronics cartridge assembly 740 that may allow relatively autonomous operation of the fluid pumping collar assembly 700 via a processor board, a controller board and/or a memory board. The electronics cartridge assembly 740 in turn is coupled to a second fluid analyzer cartridge assembly 735 that comprises a plurality of sensor cartridge assemblies 732, 734, such as an optical cartridge assembly, a pressure gauge cartridge assembly and/or a micro fluidic sensor cartridge assembly, for example. The second fluid analyzer cartridge assembly 735 in turn is coupled to a power source cartridge assembly 760, such as a turbo alternator, for example.

The electronics cartridge assembly 740 is communicably coupled to the electric line 160 for communicating data and/or power therebetween. In addition, the electronics cartridge assembly 740 may be communicably coupled to one or more of the sensors disposed in and around the fluid pumping collar assembly 700, such as the sensors in the cartridge assemblies 732, 734 of the fluid analyzer cartridge assemblies 730, 735, for example. The fluid analyzer cartridge assemblies 730, 735 may be positioned upstream and downstream of the fluid displacement cartridge assembly 750 to determine pump parameters such as position, flowrate and pressure. The electronics cartridge assembly 740 may be operatively coupled to the fluid displacement cartridge assembly 750 through the power source cartridge assembly 760 for controlling sampling operations. Optionally, the electronics cartridge assembly 740 provides closed loop control of the fluid displacement cartridge assembly 750. Other cartridge assemblies may be incorporated into the fluid pumping collar assembly 700, such as a separator cartridge assembly (not shown) comprising a membrane, a sieve and/or valves to separate portions (e.g. water, oil, solids) of the pumped fluid, and/or a volume expansion modular cartridge assembly (not shown) to vaporize gas dissolved in the pumped fluid. Any one or more of the cartridge assemblies 720, 730, 732, 734, 735, 740, 750, 760 and other cartridge assemblies incorporated into the fluid pumping collar assembly 700 may be a modular cartridge assembly according to aspects of the present disclosure as described in more detail herein. In an embodiment, all of the cartridge assemblies of the fluid pumping collar assembly 700 may be modular cartridge assemblies.

Figure 8:
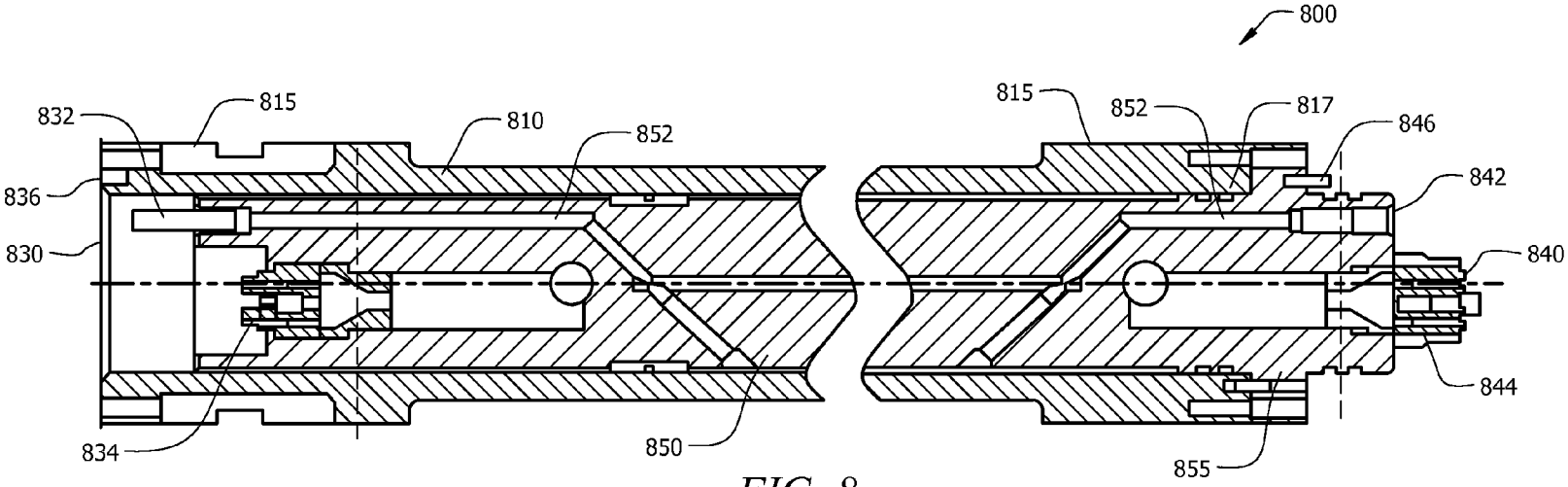
FIG. 8 is a sectional side view of part of a generic modular cartridge assembly according to one or more aspects of the present disclosure.

FIG. 8 is a sectional side view of part of a generic modular cartridge assembly 800 comprising standard design elements to facilitate configurability according to aspects of the present disclosure. The modular cartridge assembly 800 comprises a housing 810 with a chassis 850 disposed therein. The housing 810 includes an upset 815 at each end on an outer surface thereof to interface with an inner surface of a collar upon installation of the modular cartridge assembly 800 within the collar, as shown in FIGS. 5 and 6, among others. The chassis 850 may engage an inner bore of the housing 810 via seal 817 to fluidly isolate any devices retained within the cartridge assembly 800 from drilling mud flowing between the housing 810 and the collar within which the modular cartridge assembly 800 is disposed.

The chassis 850 comprises a flow line 852 and an electrical pathway (not shown) extending therethrough. The chassis 850 may optionally comprise a fluid passageway (not shown) for the passage of hydraulic fluid. The chassis 850 further comprises a first connector 830 at a first end and a second connector 840 at a second end. The first connector 830 comprises a key receptacle 836, a stabber 832 in fluid communication with the flow line 852, and an electrical connector 834 in electrical communication with the electrical pathway. Likewise, the second connector 840 comprises an alignment key 846, a stabber receptacle 842 in fluid communication with the flow line 852, and an electrical connector 844 in electrical communication with the electrical pathway. The first connector 830 and the second connector 840 may comprise standard features to permit a plurality of modular cartridge assemblies 800 to be coupled together in any desired order. Two modular cartridge assemblies 800 may be coupled together in series by coupling the first connector 830 of one modular cartridge assembly 800 to the second connector 840 of an adjacent modular cartridge assembly 800. The chassis 850 further comprises a flange 855 adjacent the second connector 840 that is locked in translation and rotation when the housing 810 of the modular cartridge assembly 800 is coupled to the housing 810 of an adjacent modular cartridge assembly 800.

Figure 9:
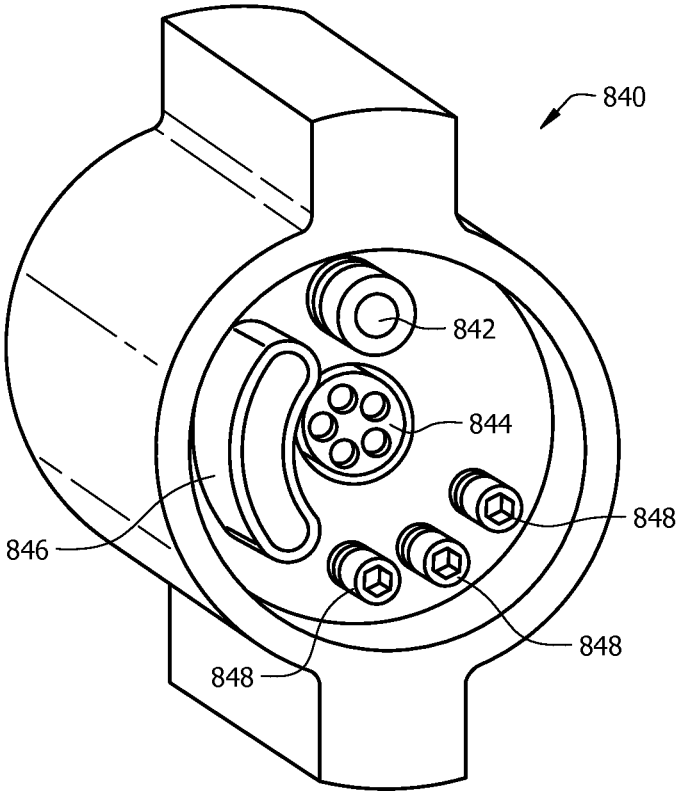
FIG. 9 is a schematic end view of a connection face of the modular cartridge assembly of FIG. 8 according to one or more aspects of the present disclosure.

FIG. 9 schematically illustrates an end view of the second connector 840 of the modular cartridge assembly 800 of FIG. 8. The second connector 840 comprises an alignment key 846 for mechanical connection to a key receptacle 836 of a first connector 830 in an adjacent modular cartridge assembly 800. The second connector 840 further comprises a stabber receptacle 842 in fluid communication with the flow line 852 for fluid connection to a stabber 832 of a first connector 830 in an adjacent modular cartridge assembly 800. The second connector 840 optionally further includes three hydraulic stabber receptacles 848 in fluid communication with hydraulic lines (e.g. high pressure, return and compensator, respectively) for hydraulic fluid connection to a hydraulic stabber (not shown) of a first connector 830 in an adjacent modular cartridge assembly 800. The second connector further includes an electrical connector 844 in electrical communication with the electrical pathway for electrical connection to an electrical connector 834 of a first connector 830 in an adjacent modular cartridge assembly 800.

Referring again to FIG. 8, in some embodiments, the generic modular cartridge assembly 800 may generally comprise the features illustrated and with no devices disposed within the chassis 850 in the area denoted by broken lines. Such generic modular cartridge assemblies 800 may be referred to as "blank" cartridge assemblies. In other embodiments, devices are connected to the flow line 852, the electrical pathway and/or the hydraulic fluid pathway.

Figure 10:
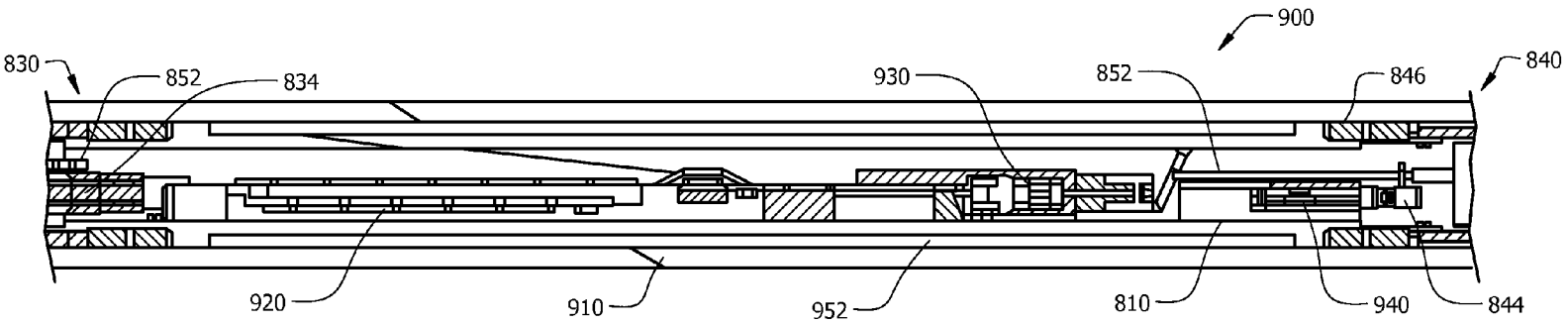
FIG. 10 is a schematic side view, partially in cross-section, of an example fluid analysis collar assembly including the modular cartridge assembly of FIG. 8 with a plurality of devices disposed therein according to one or more aspects of the present disclosure.

FIG. 10 illustrates a fluid analysis collar assembly 900 housing a generic modular cartridge assembly 800 with devices 920, 930, 940 disposed within a cavity of the chassis 850 between the first end 830 and the second end 840. The fluid analysis collar assembly 900 comprises a board 920 that may include electronics to acquire signals from a plurality of sensor assembly instruments 930, 940, such as pressure gauges, for example, and communicate measurements from those instruments 930, 940 to a bus. The board 920 may further comprise storage memory and/or a power source. Other modular cartridge assemblies, including the modular cartridge assemblies 300, 350, 600, 700 previously discussed, may be constructed with standard features like the generic modular cartridge assembly 800 to facilitate configurability of the cartridge assemblies within a collar assembly.

Figure 11:
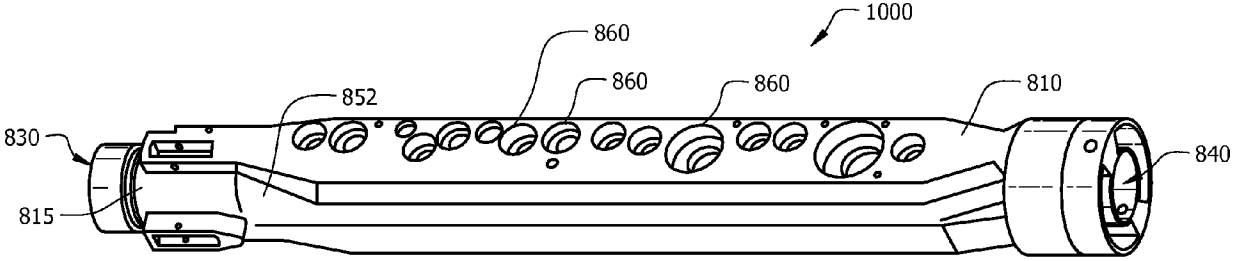
FIG. 11 is a schematic side view of the modular cartridge assembly of FIG. 8, illustrating an example housing that includes sensor receptacles in an external surface thereof according to one or more aspects of the present disclosure.
Figure 12B:
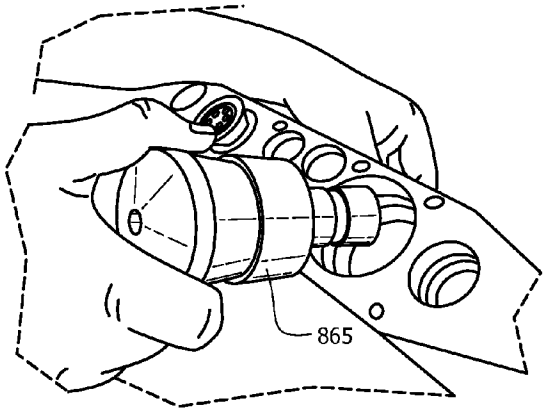
FIG. 12B is a schematic view of a sensor assembly installation into a sensor receptacle of the modular cartridge assembly of FIG. 11 according to one or more aspects of the present disclosure.
Figure 12A:
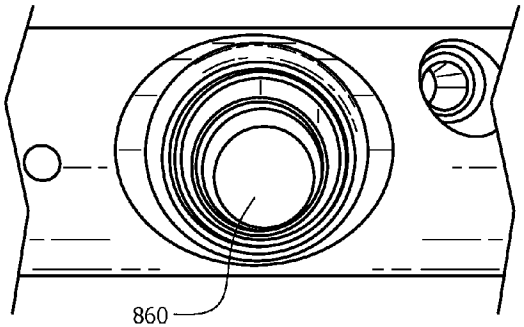
FIG. 12A is a schematic top view of a sensor receptacle of the modular cartridge assembly of FIG. 11 according to one or more aspects of the present disclosure.

FIG. 11 illustrates another generic modular cartridge assembly 1000 comprising additional receptacles 860 in the housing 810, as shown in top view in FIG. 12A, to receive sensor assemblies 865 as shown in FIG. 12B. The receptacles 860 may be provided between the upset 815 portions so that the collar contributes to maintaining the sensor assemblies 865 within the receptacles 860 during drilling. The features of the generic modular cartridge assembly 800 with sensor assembly instruments 930, 940 disposed therein, and the features of the generic modular cartridge assembly 1000 with sensor assemblies 865 disposed in receptacles on the outer surface of housing 810 are not mutually exclusive and can be made compatible.

Figure 13:
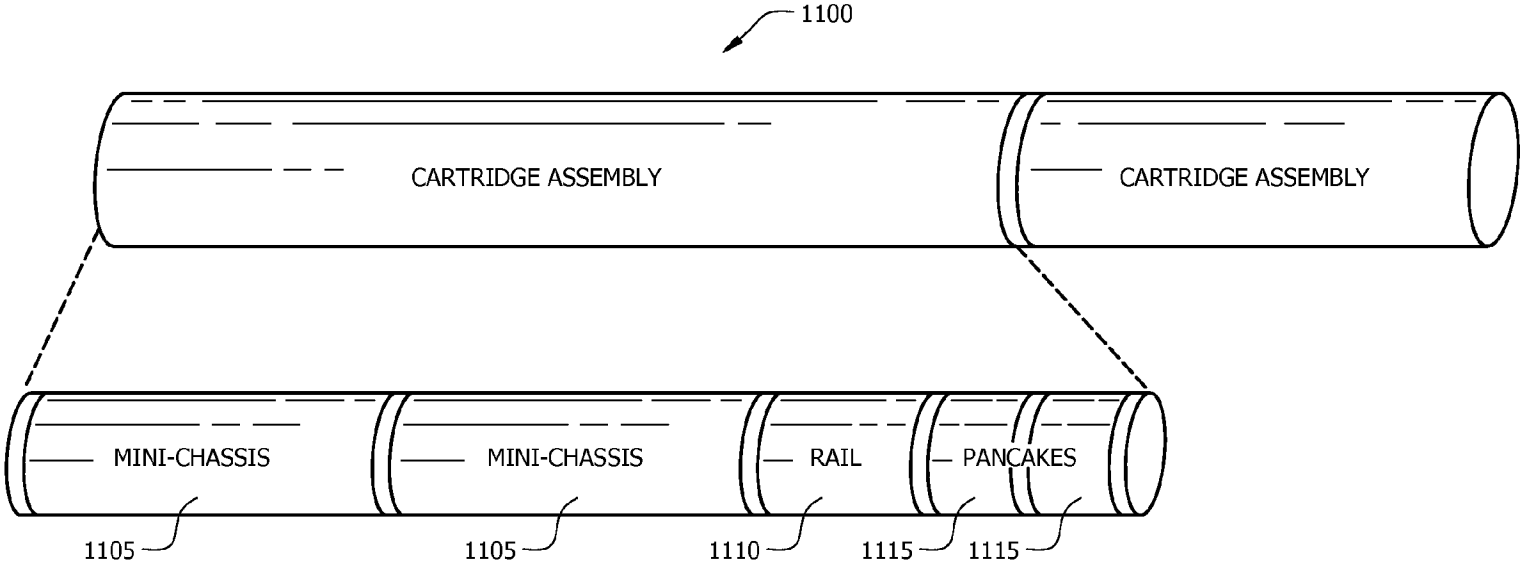
FIG. 13 is a schematic side view of a plurality of modular chassis forming a cartridge assembly according to one or more aspects of the present disclosure.

FIG. 13 depicts a chassis assembly 1100 for a modular cartridge assembly comprising a plurality of modular chassis assemblies. In more detail, the chassis assembly 1100 may comprise one or more mini chassis 1105, one or more rail chassis 1110, and/or one or more pancake chassis 1115 coupled together in series to form the chassis assembly 1100 that may be disposed with a single housing 810 of a generic modular cartridge assembly 800, for example. A mini chassis 1105 may comprise two electronic chassis bolted together to simulate a monolithic chassis. A rail chassis 1110 may comprise a common fluid line running down a path on a thin flat chassis. Various sensor assemblies can be mounted along the flat chassis and tap directly into the rail chassis 1110 fluid line. A pancake chassis 1115 may comprise stacking sensors/devices on top of electronics and stab them together, thereby producing a small chassis rotated 90-degrees from a standard chassis configuration.

Figure 14:
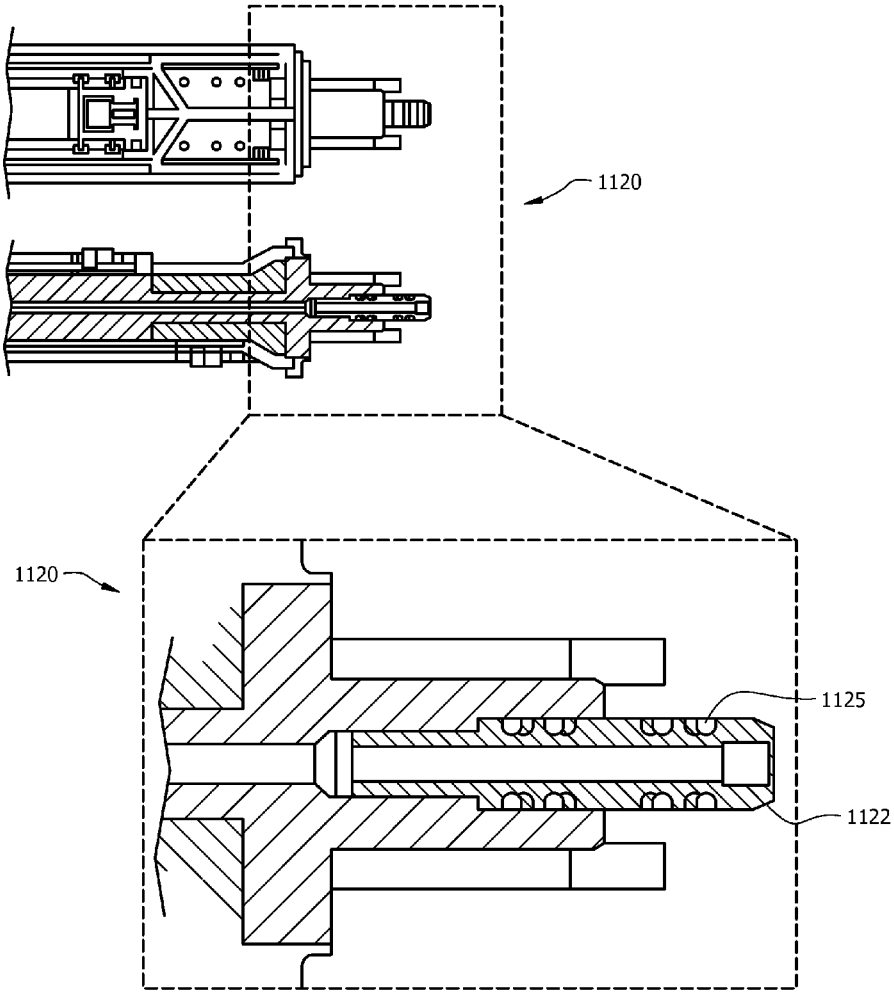
FIG. 14 is a sectional view of a modular chassis interface according to one or more aspects of the present disclosure.

The modular chassis assembly 1100 may further facilitate more flexibility and customization of the downhole tool 120 beyond any modularity and configurability provided at the collar assembly level and at the cartridge assembly level. FIG. 14 depicts modular chassis interfaces 1120 that permit coupling of the chassis assemblies in any order for configuring and reconfiguring a modular cartridge assembly of a downhole tool 120 as desired. The chassis interfaces 1120 comprise a stabber 1122 to provide fluid connection and harnesses 1125 to provide electrical connection with or without connectors therebetween.

Beyond modularity at the collar assembly level, the cartridge assembly level, and the chassis assembly level, modular sensor assemblies may also be employed. Such modular sensor assemblies may be designed to seat within predefined cavities within a chassis, such as the sensor assemblies 930, 940 within the modular cartridge assembly 800 of FIG. 10. Such modular sensor assemblies may be designed to seat within predefined receptacles on the exterior surface of the housing, such as the sensors 865 installed in receptacles 860 on the housing 810 of the modular cartridge assembly 1000 of FIGS. 11 and 12A.

In accordance with one aspect of the disclosure, an apparatus including a downhole tool for conveyance in a wellbore extending into a subterranean formation is disclosed. The downhole tool includes a modular cartridge assembly that includes a chassis assembly disposed within a housing and that includes a flow line and an electrical pathway. The downhole tool further includes a first connector at a first end of the modular cartridge assembly, and a second connector at a second end of the modular cartridge assembly. The first connector and the second connector are in fluid communication with the flow line and are further in electrical communication with the electrical pathway. The chassis assembly may further include at least one device in communication with at least one of the first and second connectors. The at least one device may be a hydraulic device, a mechanical device, a hydraulic-mechanical device, an electrical device, and/or an electro-mechanical device.

In accordance with another aspect of the disclosure, the downhole tool may further have a collar assembly that includes a first module connector at a first end and a second module connector at a second end thereof. The modular cartridge assembly may be one of a plurality of modular cartridge assemblies, each modular cartridge assembly including the chassis assembly and the first and second connectors. The collar assembly may include the plurality of modular cartridge assemblies coupled in series via coupled ones of the first and second connectors of adjacent ones of the plurality of modular cartridge assemblies. Such coupling may result in the flow lines of the plurality of modular cartridge assemblies collectively forming a flow passage extending through the collar assembly and the electrical pathways of the plurality of modular cartridge assemblies collectively forming an electrical line extending through the collar assembly.

In accordance with yet another aspect of the disclosure, the collar assembly may be one of a plurality of collar assemblies, each collar assembly including a first module connector, a second module connector, and a plurality of modular cartridge assemblies disposed therein in series via coupled ones of the first and second connectors of adjacent ones of the plurality of modular cartridge assemblies. The downhole tool may further include the plurality of collar assemblies coupled in series via coupled ones of the first and second module connectors of adjacent ones of the plurality of collar assemblies. Such coupling may result in the flow passages of the plurality of collar assemblies collectively forming a flow path extending through the downhole tool, and the electrical lines of the plurality of collar assemblies collectively forming an electrical path extending through the downhole tool.

In accordance with still another aspect of the disclosure, a method for testing a subterranean formation penetrated by a wellbore is disclosed. The method includes providing a plurality of modular cartridge assemblies, each modular cartridge assembly comprising a flow line, an electrical pathway, and first and second end connectors in fluid communication with the flow line and in electrical communication with the electrical pathway, and with the first and second end connectors of each of the plurality of modular cartridge assemblies standardized to permit coupling of the plurality of modular cartridge assemblies in any order; forming a collar assembly of a downhole tool by coupling in a desired order the plurality of modular cartridge assemblies in series via coupled ones of the first and second end connectors of adjacent ones of the plurality of modular cartridge assemblies; forming the downhole tool; conveying the downhole tool into the wellbore; and testing the subterranean formation with the downhole tool.

In accordance with another aspect of the present disclosure, a method for assembling a downhole tool is disclosed. The method includes providing a plurality of modular cartridge assemblies, each modular cartridge assembly comprising a flow line, an electrical pathway, and first and second end connectors in fluid communication with the flow line and in electrical communication with the electrical pathway, and with the first and second end connectors of each of the plurality of modular cartridge assemblies standardized to permit coupling of the plurality of modular cartridge assemblies in any order; and assembling a collar assembly including coupling in a desired order the plurality of modular cartridge assemblies in series via coupled ones of the first and second end connectors of adjacent ones of the plurality of modular cartridge assemblies.

In accordance with still another aspect of the present disclosure, a method for reconfiguring a collar assembly of a downhole tool is disclosed. The method includes providing a plurality of modular cartridge assemblies, each modular cartridge assembly comprising a flow line, an electrical pathway, and first and second end connectors in fluid communication with the flow line and in electrical communication with the electrical pathway, and with the first and second end connectors of each of the plurality of modular cartridge assemblies standardized to permit coupling of the plurality of modular cartridge assemblies in any order; forming a first collar assembly configuration by coupling in a first desired order a portion of the plurality of modular cartridge assemblies in series via coupled ones of the first and second end connectors of adjacent ones of the plurality of modular cartridge assemblies; and forming a second collar assembly configuration by coupling in a second desired order a portion of the plurality of modular cartridge assemblies in series via coupled ones of the first and second end connectors of adjacent ones of the plurality of modular cartridge assemblies.

In view of all of the above and the figures, those skilled in the art will readily appreciate that the present disclosure introduces an apparatus comprising: a downhole tool for conveyance in a wellbore extending into a subterranean formation, the downhole tool comprising a modular cartridge assembly that comprises: a chassis assembly disposed within a housing and comprising a flow line and an electrical pathway; a first connector at a first end of the modular cartridge assembly; and a second connector at a second end of the modular cartridge assembly; wherein the first connector and the second connector are in fluid communication with the flow line and are further in electrical communication with the electrical pathway. The first and second connectors may be standardized to permit coupling of the modular cartridge assembly with other modular cartridge assemblies of the downhole tool in any order. The chassis assembly may further comprise at least one device in communication with at least one of the first and second connectors, wherein the at least one device is selected from the group consisting of a hydraulic device, a mechanical device, a hydraulic-mechanical device, an electrical device, and an electro-mechanical device. The modular cartridge assembly may be selected from the group consisting of a flow diverter cartridge assembly, a power source cartridge assembly, a fluid analyzer cartridge assembly, an electronics cartridge assembly, a hydraulic cartridge assembly, a pretest cartridge assembly, a fluid routing/equalization cartridge assembly, a memory cartridge assembly, a machined probe cartridge assembly, and a fluid displacement cartridge assembly. The modular cartridge assembly may be selected from the group consisting of a flow diverter cartridge assembly, a power source cartridge assembly, a fluid analyzer cartridge assembly, an electronics cartridge assembly, a hydraulic cartridge assembly, a pretest cartridge assembly, a fluid routing/equalization cartridge assembly, a memory cartridge assembly, a machined probe cartridge assembly, and a fluid displacement cartridge assembly. The chassis assembly may comprise a plurality of modular chassis assemblies coupled together in series via respective first and second interfaces of adjacent ones of the plurality of modular chassis assemblies. Each of the plurality of modular chassis assemblies may be selected from the group consisting of a mini chassis assembly, a rail chassis assembly, and a pancake chassis assembly. At least one of the chassis assembly and the housing may further comprise a receptacle to receive a sensor assembly. The sensor assembly may be a modular sensor assembly comprising a sensor selected from the group consisting of a pressure gauge, a resistivity cell, a micro fluidics sensor, and an optical sensor. At least one of the first and second connectors may comprise a mechanical alignment feature. The housing may comprise an upset on an outer surface thereof to facilitate insertion of the modular cartridge assembly into a collar assembly of the downhole tool. The chassis assembly may sealingly engage an inner bore of the housing. Each of the first and second connectors may comprise a fluid connector to fluidly couple the modular cartridge assembly to another component of the downhole tool. Each of the first and second connectors may comprise an electrical connector to electrically couple the modular cartridge assembly to another component of the downhole tool. Each of the first and second connectors may comprise a hydraulic connector to hydraulically couple the modular cartridge assembly to another component of the downhole tool.

The downhole tool may further comprise a collar assembly comprising: a first module connector at a first end of the collar assembly; and a second module connector at a second end of the collar assembly; the modular cartridge assembly is one of a plurality of modular cartridge assemblies, each modular cartridge assembly comprising a chassis assembly, a first connector, and a second connector; the collar assembly comprises the plurality of modular cartridge assemblies coupled in series via coupled ones of the first and second connectors of adjacent ones of the plurality of modular cartridge assemblies, whereby: the flow lines of the plurality of modular cartridge assemblies collectively form a flow passage extending through the collar assembly; and the electrical pathways of the plurality of modular cartridge assemblies collectively form an electrical line extending through the collar assembly. The collar assembly may further comprise a fluid passageway extending therethrough. The collar assembly may be selected from the group consisting of a pump out module, a sample carrier module, a probe tool module, a fluid analysis module, a memory sub, a measurement sub, and a fluid routing sub. The downhole tool may further comprise: a jam sub coupled to a first end of the collar assembly; and an adjustable device disposed between the jam sub and the collective plurality of modular cartridge assemblies to adjustably retain the plurality of modular cartridge assemblies within the collar assembly. The adjustable device may comprise at least one biasing member. The adjustable device may comprise a spring pack. The downhole tool may further comprise a machined collar coupled to a second end of the collar assembly. The first and second connectors of each of the plurality of modular cartridge assemblies may be standardized to permit coupling of the plurality of modular cartridge assemblies in any order. Each of the plurality of modular cartridge assemblies may be selected from the group consisting of a blank cartridge assembly, a hydraulic cartridge assembly, a mechanical cartridge assembly, a hydraulic-mechanical cartridge assembly, an electrical cartridge assembly, and an electro-mechanical cartridge assembly. Each of the plurality of modular cartridge assemblies may be selected from the group consisting of a flow diverter cartridge assembly, a power source cartridge assembly, a fluid analyzer cartridge assembly, an electronics cartridge assembly, a hydraulic cartridge assembly, a pretest cartridge assembly, a fluid routing/equalization cartridge assembly, a memory cartridge assembly, a machined probe cartridge assembly, and a fluid displacement cartridge assembly. At least one of the plurality of modular cartridge assemblies may further comprise a plurality of modular chassis assemblies coupled together in series. Each of the plurality of modular chassis assemblies may be selected from the group consisting of a mini chassis, a rail chassis and a pancake chassis. The chassis assembly of each of the plurality of modular cartridge assemblies may be selected from the group consisting of a mini chassis, a rail chassis, and a pancake chassis. At least one of the plurality of modular cartridge assemblies may further comprise a modular sensor assembly comprising a sensor selected from the group consisting of a pressure gauge, a resistivity cell, a micro fluidics sensor, and an optical sensor. The collar assembly may be one of a plurality of collar assemblies, each collar assembly comprising a first module connector and a second module connector; and the downhole tool may comprise the plurality of collar assemblies coupled in series via coupled ones of the first and second module connectors of adjacent ones of the plurality of collar assemblies. The collar assembly may be one of a plurality of collar assemblies, each collar assembly comprising a first module connector, a second module connector and a plurality of modular cartridge assemblies disposed therein in series via coupled ones of the first and second connectors of adjacent ones of the plurality of modular cartridge assemblies; and the downhole tool may comprise the plurality of collar assemblies coupled in series via coupled ones of the first and second module connectors of adjacent ones of the plurality of collar assemblies, whereby: the flow passages of the plurality of collar assemblies collectively form a flow path extending through the downhole tool; and the electrical lines of the plurality of collar assemblies collectively form an electrical path extending through the downhole tool. The fluid passages of the plurality of collar assemblies may collectively form a flow path extending through the downhole tool. The first and second module connectors of each of the plurality of collar assemblies may be standardized to permit coupling of the plurality of collar assemblies in any order. The first and second module connectors of each of the plurality of collar assemblies may be standardized to permit coupling of the plurality of collar assemblies in any order. Each of the plurality of collar assemblies may be selected from the group consisting selected from the group consisting of a pump out module, a sample carrier module, a probe tool module, a fluid analysis module, a memory sub, a measurement sub, and a fluid routing sub. Each of the plurality of collar assemblies may be selected from the group consisting selected from the group consisting of a pump out module, a sample carrier module, a probe tool module, a fluid analysis module, a memory sub, a measurement sub, and a fluid routing sub. Each of the plurality of modular cartridge assemblies disposed in the collar assembly may be selected from the group consisting of a blank cartridge assembly, a hydraulic cartridge assembly, a mechanical cartridge assembly, a hydraulic-mechanical cartridge assembly, an electrical cartridge assembly, and an electro-mechanical cartridge assembly. Each of the plurality of modular cartridge assemblies disposed in each of the plurality of collar assemblies may be selected from the group consisting of a flow diverter cartridge assembly, a power source cartridge assembly, a fluid analyzer cartridge assembly, an electronics cartridge assembly, a hydraulic cartridge assembly, a pretest cartridge assembly, a fluid routing/equalization cartridge assembly, a memory cartridge assembly, a machined probe cartridge assembly, and a fluid displacement cartridge assembly. Each of the plurality of modular cartridge assemblies disposed in each of the plurality of collar assemblies may be selected from the group consisting of a flow diverter cartridge assembly, a power source cartridge assembly, a fluid analyzer cartridge assembly, an electronics cartridge assembly, a hydraulic cartridge assembly, a pretest cartridge assembly, a fluid routing/equalization cartridge assembly, a memory cartridge assembly, a machined probe cartridge assembly, and a fluid displacement cartridge assembly. Each of the plurality of modular cartridge assemblies disposed in each of the plurality of collar assemblies may be selected from the group consisting of a flow diverter cartridge assembly, a power source cartridge assembly, a fluid analyzer cartridge assembly, an electronics cartridge assembly, a hydraulic cartridge assembly, a pretest cartridge assembly, a fluid routing/equalization cartridge assembly, a memory cartridge assembly, a machined probe cartridge assembly, and a fluid displacement cartridge assembly. At least one of the plurality of modular cartridge assemblies in the collar assembly may comprise a plurality of modular chassis assemblies coupled together in series. At least one of the plurality of modular cartridge assemblies in the plurality of collar assemblies may comprise a plurality of modular chassis assemblies coupled together in series. Each of the plurality of modular chassis assemblies may be selected from the group consisting of a mini chassis, a rail chassis, and a pancake chassis. Each of the plurality of modular chassis assemblies may be selected from the group consisting of a mini chassis, a rail chassis, and a pancake chassis. At least one of the plurality of modular cartridge assemblies may further comprise a modular sensor assembly comprising a sensor selected from the group consisting of a pressure gauge, a resistivity cell, a micro fluidics sensor, and an optical sensor. At least one of the plurality of modular cartridge assemblies in the at least one of the plurality of collar assemblies may further comprise a modular sensor assembly comprising a sensor selected from the group consisting of a pressure gauge, a resistivity cell, a micro fluidics sensor, and an optical sensor. The downhole tool may comprise a system for testing the subterranean formation.

The present disclosure also introduces a method for testing a subterranean formation penetrated by a wellbore comprising: providing a plurality of modular cartridge assemblies, each modular cartridge assembly comprising a flow line, an electrical pathway, and first and second end connectors in fluid communication with the flow line and in electrical communication with the electrical pathway; wherein the first and second end connectors of each of the plurality of modular cartridge assemblies are standardized to permit coupling of the plurality of modular cartridge assemblies in any order; forming a collar assembly of a downhole tool by coupling in a desired order the plurality of modular cartridge assemblies in series via coupled ones of the first and second end connectors of adjacent ones of the plurality of modular cartridge assemblies; forming the downhole tool; conveying the downhole tool into the wellbore; and testing the subterranean formation with the downhole tool. The collar assembly may be one of a plurality of collar assemblies, each collar assembly comprising a first module connector and a second module connector; and forming the downhole tool may comprise coupling the plurality of collar assemblies in series via coupled ones of the first and second module end connectors of adjacent ones of the plurality of collar assemblies.

The present disclosure also introduces a method for assembling a downhole tool comprising: providing a plurality of modular cartridge assemblies, each modular cartridge assembly comprising a flow line, an electrical pathway, and first and second end connectors in fluid communication with the flow line and in electrical communication with the electrical pathway; wherein the first and second end connectors of each of the plurality of modular cartridge assemblies are standardized to permit coupling of the plurality of modular cartridge assemblies in any order; and assembling a collar assembly comprising coupling in a desired order the plurality of modular cartridge assemblies in series via coupled ones of the first and second end connectors of adjacent ones of the plurality of modular cartridge assemblies. The collar assembly may be one of a plurality of collar assemblies, each collar assembly comprising a first module connector and a second module connector; and the method may further comprise coupling the plurality of collar assemblies in series via coupled ones of the first and second module connectors of adjacent ones of the plurality of collar assemblies. The method may further comprise assembling each of the plurality of collar assemblies by coupling in a desired order a plurality of modular cartridge in series via coupled ones of the first and second end connectors of adjacent ones of the plurality of modular cartridge assemblies. The first and second module connectors of each of the plurality of collar assemblies may be standardized to permit coupling of the plurality of collar assemblies in any order; and forming the downhole tool may further comprise coupling the plurality of collar assemblies in series in a desired order. The first and second module connectors of each of the plurality of collar assemblies may be standardized to permit coupling of the plurality of collar assemblies in any order; and forming the downhole tool may further comprise coupling the plurality of collar assemblies in series in a desired order. The method may further comprise assembling at least one of the plurality of modular cartridge assemblies by coupling a plurality of modular chassis assemblies in series.

The present disclosure also introduces a method of reconfiguring a collar assembly of a downhole tool comprising: providing a plurality of modular cartridge assemblies, each modular cartridge assembly comprising a flow line, an electrical pathway, and first and second end connectors in fluid communication with the flow line and in electrical communication with the electrical pathway; wherein the first and second end connectors of each of the plurality of modular cartridge assemblies are standardized to permit coupling of the plurality of modular cartridge assemblies in any order; forming a first collar assembly configuration by coupling in a first desired order a portion of the plurality of modular cartridge assemblies in series via coupled ones of the first and second end connectors of adjacent ones of the plurality of modular cartridge assemblies; and forming a second collar assembly configuration by coupling in a second desired order a portion of the plurality of modular cartridge assemblies in series via coupled ones of the first and second end connectors of adjacent ones of the plurality of modular cartridge assemblies. At least one of the plurality of modular cartridge assemblies of the first collar assembly configuration may be duplicated in the second collar assembly configuration. At least one of the plurality of modular cartridge assemblies of the first collar assembly configuration may be omitted in the second collar assembly configuration. The second collar assembly configuration may comprise a rearrangement of the plurality of modular cartridge assemblies of the first collar assembly configuration. The first collar assembly configuration may be a probe collar assembly comprising a first fluid analyzer cartridge assembly coupled to an electronics cartridge assembly coupled to a hydraulic cartridge assembly coupled to a pretest cartridge assembly coupled to a fluid routing/equalization cartridge assembly coupled to a second fluid analyzer cartridge assembly. The second collar assembly configuration may be a probe collar assembly with the first fluid analyzer cartridge assembly omitted. The second collar assembly configuration may comprise a blank cartridge assembly coupled to the electronics cartridge assembly. The second collar assembly configuration may be a fluid pumping module cartridge assembly comprising the first fluid analyzer cartridge assembly coupled to the electronics cartridge assembly coupled to a fluid displacement cartridge assembly coupled to the second fluid analyzer cartridge assembly.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. An apparatus, comprising:

a downhole tool for conveyance in a wellbore extending into a subterranean formation, the downhole tool comprising:

a collar assembly that comprises:

a collar;

a first module connector at a first end of the collar;

a second module connector at a second end of the collar; and a modular cartridge assembly comprising:

a chassis assembly disposed within a housing and comprising a flow line and an electrical pathway;

a first connector at a first end of the modular cartridge assembly; and a second connector at a second end of the modular cartridge assembly;

wherein the first connector and the second connector are in fluid communication with the flow line and are further in electrical communication with the electrical pathway;

a jam sub coupled to a first end of the collar assembly; and an adjustable device disposed between the jam sub and the modular cartridge assembly to adjustably retain the modular cartridge assembly within the collar assembly, wherein the adjustable device is selected from the group consisting of:

a spring pack; and at least one biasing member.

2. The apparatus of claim 1 wherein the first and second connectors of the modular cartridge assembly are standardized to permit coupling of the modular cartridge assembly with other modular cartridge assemblies in any order.

3. The apparatus of claim 1 wherein the chassis assembly further comprises at least one device in communication with at least one of the first and second connectors, wherein the at least one device is selected from the group consisting of a hydraulic device, a mechanical device, a hydraulic-mechanical device, an electrical device, and an electro-mechanical device.

4. The apparatus of claim 3 wherein the modular cartridge assembly is selected from the group consisting of a flow diverter cartridge assembly, a power source cartridge assembly, a fluid analyzer cartridge assembly, an electronics cartridge assembly, a hydraulic cartridge assembly, a pretest cartridge assembly, a fluid routing/equalization cartridge assembly, a memory cartridge assembly, a machined probe cartridge assembly, and a fluid displacement cartridge assembly.

5. The apparatus of claim 1 wherein the modular cartridge assembly is selected from the group consisting of a flow diverter cartridge assembly, a power source cartridge assembly, a fluid analyzer cartridge assembly, an electronics cartridge assembly, a hydraulic cartridge assembly, a pretest cartridge assembly, a fluid routing/equalization cartridge assembly, a memory cartridge assembly, a machined probe cartridge assembly, and a fluid displacement cartridge assembly.

6. The apparatus of claim 1 wherein the chassis assembly is selected from the group consisting of a mini chassis assembly, a rail chassis assembly, and a pancake chassis assembly.

7. The apparatus of claim 1 wherein at least one of the chassis assembly and the housing further comprises a receptacle to receive a sensor assembly.

8. The apparatus of claim 7 wherein the sensor assembly is a modular sensor assembly comprising a sensor selected from the group consisting of a pressure gauge, a resistivity cell, a micro fluidics sensor, and an optical sensor.

9. The apparatus of claim 1 wherein at least one of the first and second connectors comprises a mechanical alignment feature.

10. The apparatus of claim 1 wherein the housing comprises an upset on an outer surface thereof to interface with an inner surface of the collar upon installation of the modular cartridge assembly into the collar assembly.

11. The apparatus of claim 1 wherein the chassis assembly sealingly engages an inner bore of the housing.

12. The apparatus of claim 1 wherein each of the first and second connectors comprises a fluid connector to fluidly couple to another component of the downhole tool.

13. The apparatus of claim 1 wherein each of the first and second connectors comprises an electrical connector to electrically couple to another component of the downhole tool.

14. The apparatus of claim 1 wherein each of the first and second connectors comprises a hydraulic connector to hydraulically couple to another component of the downhole tool.

15. The apparatus of claim 1 wherein the collar assembly further comprises a fluid passageway extending therethrough.

16. The apparatus of claim 1 wherein the collar assembly is selected from the group consisting of a pump out module, a sample carrier module, a probe tool module, a fluid analysis module, a memory sub, a measurement sub, and a fluid routing sub.

17. The apparatus of claim 1 wherein:

the collar assembly is one of a plurality of collar assemblies, each collar assembly comprising the first module connector and the second module connector; and the downhole tool comprises the plurality of collar assemblies coupled in series via coupled ones of the first and second module connectors of adjacent ones of the plurality of collar assemblies.

18. The apparatus of claim 1 wherein:

the collar assembly is one of a plurality of collar assemblies, each collar assembly comprising the first module connector, the second module connector and a plurality of modular cartridge assemblies disposed therein in series via coupled ones of the first and second connectors of adjacent ones of the plurality of modular cartridge assemblies; and the downhole tool comprises the plurality of collar assemblies coupled in series via coupled ones of the first and second module connectors of adjacent ones of the plurality of collar assemblies, whereby:

the flow passages of the plurality of collar assemblies collectively form a flow path extending through the downhole tool; and the electrical lines of the plurality of collar assemblies collectively form an electrical path extending through the downhole tool.

19. The apparatus of claim 18 wherein fluid passages of the plurality of collar assemblies collectively form a flow path extending through the downhole tool.

20. The apparatus of claim 18 wherein the first and second module connectors of each of the plurality of collar assemblies are standardized to permit coupling of the plurality of collar assemblies in any order.

21. The apparatus of claim 18 wherein each of the plurality of collar assemblies is selected from the group consisting selected from the group consisting of a pump out module, a sample carrier module, a probe tool module, a fluid analysis module, a memory sub, a measurement sub, and a fluid routing sub.

22. The apparatus of claim 1 wherein the downhole tool comprises a system for testing the subterranean formation.

23. A method for assembling a downhole tool, comprising:

providing a modular cartridge assembly comprising a chassis assembly disposed within a housing, wherein the chassis assembly sealingly engages an inner bore of the corresponding housing, wherein the chassis assembly comprises a flow line and an electrical pathway, wherein the modular cartridge assembly comprises first and second end connectors in fluid communication with the flow line and in electrical communication with the electrical pathway;

assembling a first collar assembly having the modular cartridge assembly coupling the first collar assembly to a second collar assembly.

24. The method of claim 23 wherein:

the first collar assembly and the second collar assembly are each one of a plurality of collar assemblies, each comprising a first module connector and a second module connector; and the method further comprises coupling the plurality of collar assemblies in series via coupled ones of the first and second module connectors of adjacent ones of the plurality of collar assemblies.

25. The method of claim 23 wherein the first and second end connectors of the modular cartridge assembly are standardized to permit coupling of the modular cartridge assembly with other modular cartridge assemblies in any order.

26. A downhole tool for conveyance in a wellbore extending into a subterranean formation, the downhole tool comprising:

a collar assembly comprising:

a first module connector at a first end of the collar assembly;

a second module connector at a second end of the collar assembly; and a plurality of modular cartridge assemblies each comprising:

a chassis assembly comprising a flow line and an electrical pathway;

a first connector at a first end of the modular cartridge assembly; and a second connector at a second end of the modular cartridge assembly, wherein the first and second connectors are in fluid communication with the flow line and in electrical communication with the electrical pathway, and wherein the plurality of modular cartridge assemblies are collectively coupled in series via coupled ones of the first and second connectors of adjacent ones of the plurality of modular cartridge assemblies, whereby:

the flow lines of the plurality of modular cartridge assemblies collectively form a flow passage extending through the collar assembly; and the electrical pathways of the plurality of modular cartridge assemblies collectively form an electrical line extending through the collar assembly;

a jam sub coupled to a first end of the collar assembly; and an adjustable device disposed between the jam sub and the collective plurality of modular cartridge assemblies to adjustably retain the plurality of modular cartridge assemblies within the collar assembly, wherein the adjustable device is selected from the group consisting of:

a spring pack; and at least one biasing member.

27. The downhole tool of claim 26 wherein:

the chassis assembly of at least one of the plurality of modular cartridge assemblies further comprises at least one device in communication with at least one of the first and second connectors of at least one of the plurality of modular cartridge assemblies;

the at least one device is selected from the group consisting of a hydraulic device, a mechanical device, a hydraulic-mechanical device, an electrical device, and an electro-mechanical device;

each of the plurality of modular cartridge assemblies is selected from the group consisting of a flow diverter cartridge assembly, a power source cartridge assembly, a fluid analyzer cartridge assembly, an electronics cartridge assembly, a hydraulic cartridge assembly, a pre-test cartridge assembly, a fluid routing/equalization cartridge assembly, a memory cartridge assembly, a machined probe cartridge assembly, and a fluid displacement cartridge assembly;

the chassis assembly of each of the plurality of modular cartridge assemblies is selected from the group consisting of a mini chassis assembly, a rail chassis assembly, and a pancake chassis assembly;

the collar assembly is one of a plurality of collar assemblies coupled end to end;

the downhole tool comprises the plurality of collar assemblies; and ones of the plurality of collar assemblies are each selected from the group consisting of a pump out module, a sample carrier module, a probe tool module, a fluid analysis module, a memory sub, a measurement sub, and a fluid routing sub.

28. The downhole tool of claim 26 wherein the downhole tool comprises a system for testing the subterranean formation.

* * * * *